US005676097A

United States Patent [19]

Montresor

[11] Patent Number: 5,676,097

[45] Date of Patent: Oct. 14, 1997

[54] HIGH-EFFICIENCY EXPLOSION ENGINE PROVIDED WITH A DOUBLE-ACTING PISTON COOPERATING WITH AUXILIARY FEED INLET UNITS

[76] Inventor: Gianfranco Montresor, Via Ruffoni, 5 Verona, Italy

[21] Appl. No.: 709,469

[22] Filed: Sep. 5, 1996

[30] Foreign Application Priority Data

Sep. 22, 1995 [IT] Italy ..... VR95A0079

[51] Int. Cl.[6] ..... F02B 41/00

[52] U.S. Cl. ..... 123/61 R

[58] Field of Search ..... 123/61 R, 62, 123/63

[56] References Cited

U.S. PATENT DOCUMENTS

| | | | |
|---|---|---|---|
| 2,070,769 | 2/1937 | Wurtele | 123/61 R |
| 2,392,052 | 1/1946 | Matheisel | 123/61 R |
| 4,414,927 | 11/1983 | Simon | 123/61 R |
| 4,913,100 | 4/1990 | Eickmann | 123/61 R |
| 5,285,752 | 2/1994 | Reed | 123/61 R |

*Primary Examiner*—Marguerite McMahon

*Attorney, Agent, or Firm*—Notaro & Michalos P.C.

[57] ABSTRACT

The present invention refers to a double-acting, single-cylinder, explosion engine whose peculiarity is to be provided with auxiliary components which permit to optimize the inlet stroke because such auxiliary components are arranged in a way that the gases to be burnt are not inlet by the piston. Such gases are inlet by the auxiliary components.

In general the present engine (1) comprises a cylinder (2) in which a piston (3) may run. The median axis of the piston (3) is interested by a through-shaft which is fixed and coaxial to the piston itself. The shaft is divided in two half-shafts (4, 5) having the same size and shape by the piston.

The half-shafts (4, 5) comprise pistons (14, 15) which may run in inlet chambers (10, 11) and narrowings (12, 13) or holes, openings, leaks or the like through which the inlet gas passes to reach the respective explosion chambers through heads (8, 9). The cylinder (2) is provided with exhausts (21) at its median part.

The above described engine (1) is connected with at least a connecting rod (16) and is able to do two active bursts during a turn of 360° of the connecting rod.

8 Claims, 2 Drawing Sheets

HIGH-EFFICIENCY EXPLOSION ENGINE PROVIDED WITH A DOUBLE-ACTING PISTON COOPERATING WITH AUXILIARY FEED INLET UNITS

DESCRIPTION

The present patent for industrial invention refers to a high-efficiency explosion engine of the endothermic type whose peculiarity is to be provided with a double-acting piston cooperating with feed and inlet units.

As it is known, the carburation engines or the internal combustion engines, i.e. the so-called explosion engines, are provided with a cylinder in which a piston may run to impart a cyclic movement to a connecting rod keyed on the driving shaft.

In addition to the cylinder and piston, the four-stroke engines are provided with inlet-valves and exhaust valves as well as opening and closing mechanisms for the valves. In particular the engines of motor-cars are provided with side valves or head valves. The side valves are arranged by the side and open in a side chamber while the head valves are arranged in the bottom of the cylinder immediately looking on to the inside of the cylinder and called "head". The head valves are preferred technically.

In the two-stroke engines there are not valves usually but only "ports", i.e. holes made in the cylinder. Such holes are uncovered when the piston is near the bottom dead center. It is evident the constructive simplification resulting from such an arrangement although it is even likely the most of the air coming from the washing ports will escape through the exhaust ports which are near the washing ports.

There are several systems for increasing the single powers of the engines, for instance lightening of the alternate masses and enlargement of the valves, which permits to increase the average speed of the piston, the resort to a two-stroke cycle which doubles the power under the same conditions and the use of the so-called "double-acting effect" which consists in closing the cylinder at both ends so that the piston subdivides the cylinder itself in two chambers in both of which a cycle takes place simultaneously.

However, the double-acting cylinder type has not been developed in a substantial way up to now because this type of cylinder is considered to be less safe than a single-acting cylinder. The aim of the present invention is to conceive and carry out a double-acting cylinder explosion engine whose peculiarity is the presence of auxiliary components which permit to optimize the inlet strokes because such auxiliary components are arranged in such a way that the gases to be burnt are not intaken by the piston. The gases are intaken by the auxiliary components.

An immediate advantage obtained with the present invention is a much higher efficiency of the present engine than all the other explosion engines.

All the above aims and advantages are reached according to the present invention by a high-efficiency engine which is provided with a double-acting piston cooperating with auxiliary feed and inlet units, characterized by the fact that it comprises a cylinder in which a piston may slide, a through-shaft being fixed on the central axis of the piston; the though-shaft is divided by the piston in two particularly shaped semi-shafts whose outer ends are provided with auxiliary pistons which slide in suitable inlet chambers, and that at least one of the two free ends of the said semi-shafts is dovetailed to a connecting rod or the like; the said inlet chambers are preferably provided with valves causing the entry of gases; the central part of the cylinder is provided with exhaust openings; the said piston and the relative through-shaft may be displaced axially and cyclically according to two active explosions with a turn of the connecting rod of 360°.

Further characteristics and details of the present invention will result from the following description which describes a preferred embodiment, given as an example not limiting the present invention, on the hand of the accompanying drawings wherein.

Figure 1:
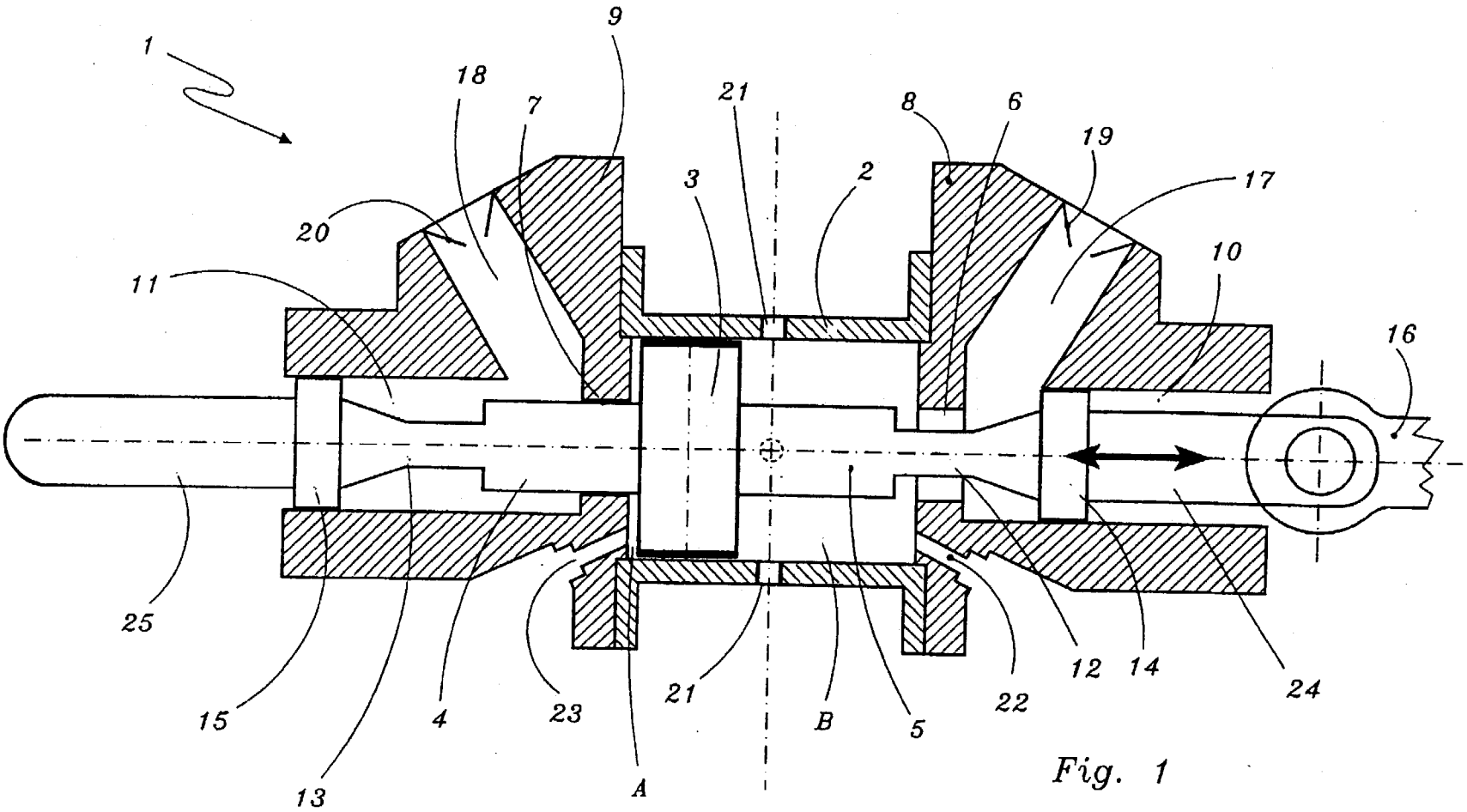
FIG. 1 shows a schematic view of the engine as a whole according to the present invention.
Figure 2:
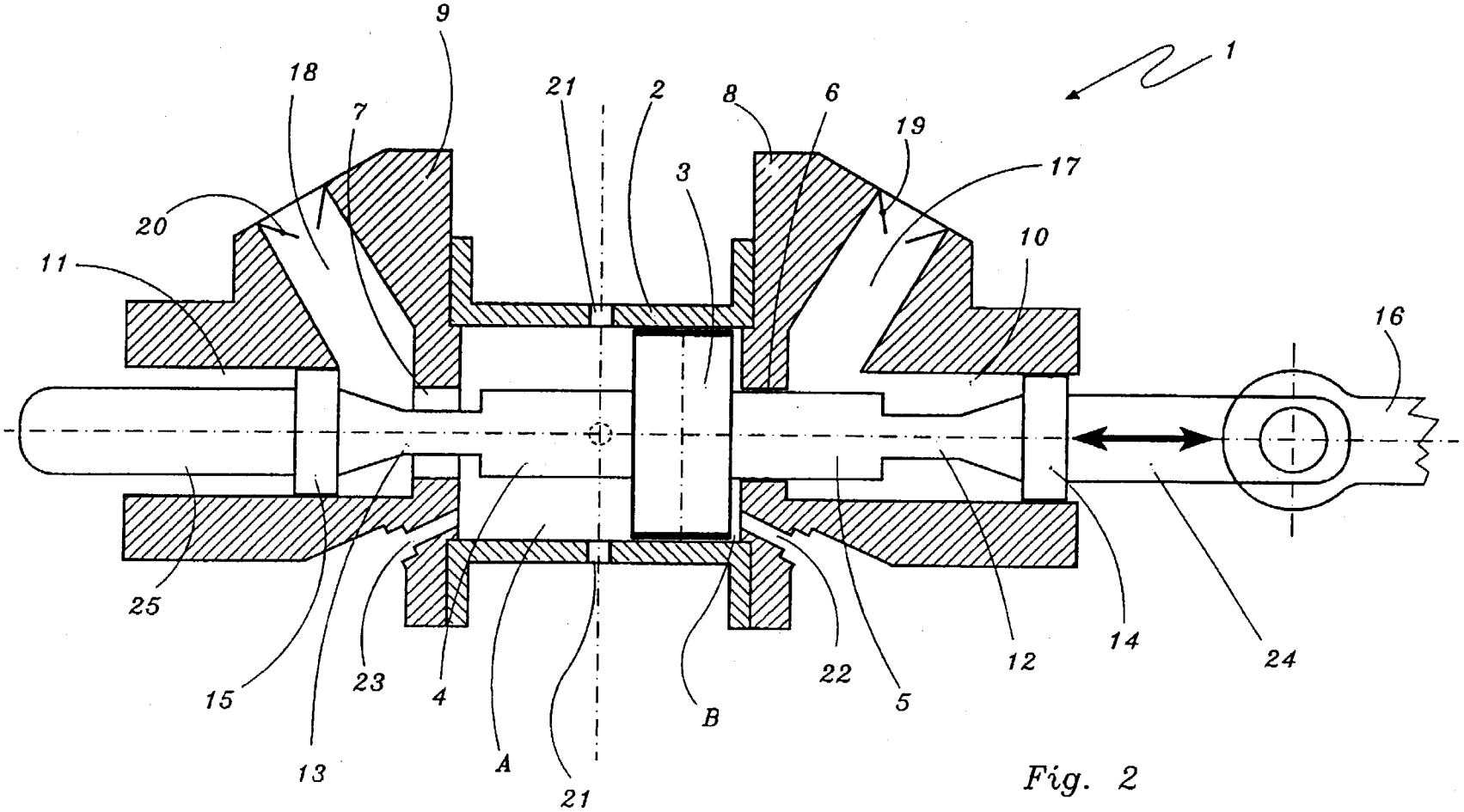
FIG. 2 shows a schematic view of the engine in a working phase contrary to the preceding one.

With reference to the accompanying drawings, number 1 denotes an engine as a whole according to the present invention. In general, this engine consists of a cylinder 2 in which a piston 3 may slide. The central axis of the piston is intersected by a through-shaft which is fixed and coaxial to the piston itself. The shaft is subdivided by the piston in two semi-shafts 4 and 5 having the same size and shape. Beginning from the piston 3 outwards, the two semi-shafts 4 and 5 pass through openings 6 and 7, which may be provided with elastic bands or similar gaskets. The said openings 6 and 7 are made in bodies or heads 8 and 9 which are fixed to the two ends of the cylinder 2. In addition, the semi-shafts 4 and 5 pass through suitable inlet chambers 10 and 11 which are obtained in the inside of the heads 8 and 9. Moreover, the semi-shafts 4 and 5 show narrowings or the like 12 and 13. The more external parts of such narrowings end in pistons 14 and 15 which slide in the above described inlet chambers 10 and 11. The narrowings 12 and 13 may be holes, leaks or the like and permit the inlet gas to be conveyed to the respective explosion chambers.

A connecting rod 16 is dovetailed on at least one of the two free ends of the semi-shafts 4 and 5, and precisely on the free end of the semi-shaft 5. The connecting rod 16 receives the cyclic movement for rotating the driving shaft, as described below.

In addition, the bodies or heads 8 and 9 are provided with openings 17 and 18 communicating with the inlet chambers 10 and 11. Inlet valves 19 and 20 are arranged at the mouths of the said inlet chambers.

The median part of the cylinder 2 is provided with exhausts 21. Seats 22 and 23 are obtained at both opposite head sides. Sparking plugs are inserted in the said seats 22 and 23. All the pistons 3, 14 and 15 are provided with elastic bands or other similar gaskets or packings. External parts 24 and 25 of the two semi-shafts 4 and 5 may slide in suitable supports.

The piston 3 subdivides the inside of the cylinder 2 in two chambers indicated with A and B.

Now, an example of working of the engine according to the present invention will be described briefly.

At the beginning of the first cycle, the sparking-plug inserted in the seat 23 causes an explosion in the chamber A in which the mixture had been pressed previously. Then, the piston 3 moves towards the chamber B and presses the gas contained in this chamber.

When the piston 3 accomplishes the above movement, the auxiliary piston 14 draws back and intakes the gas from the valve 19. At the same time, the opposite auxiliary piston 15 introduces the gas in the chamber A while the gases produced by the preceding combustion go out through the exhausts 21.

When the piston 3 reaches the stroke end in the chamber B, the sparking-plug inserted in the seat 22 causes the explosion of the gas pressed and the return movement of the piston 3 in the opposite direction.

In this phase, the auxiliary piston 14 introduces the fuel in the chamber B, which fuel had been intaken previously by the valve 19 while the piston 3 lets the burnt gases to go out through the openings 21 and the auxiliary piston 15 intakes new fuel through the valve 20 and begins a new cycle.

Accordingly, the above described engine can perform two active bursts with one turn of 360° of the connecting rod and that is the reason why the engine according to the present invention is different from the conventional four-stroke and two-stroke engines found on the market. In fact, in the prior art solutions a four-stroke engine performs one burst or active phase with two turns of 360° of the crankshaft while a two-stroke engine performs one burst with one turn of 360°.

Moreoover, the concept of the engine according to the present invention is very different from the concept of the conventional double-acting two-stroke and four stroke engines because the known double-acting engines may be subdivided theoretically in two equal engines while this is not possible in the engine according to the present invention where there is a crossed working. More precisely, the intake and inlet of fuel in a sector is caused in the engine according to the present invention by the action of the opposite sector.

Another important aspect to be considered is the following: the known double-acting two stroke engines have the intake and exhaust openings at the height of the bottom dead center of the cylinder opposite to the explosion part whereas the exhausts in the engine according to the present invention occur in the bottom dead centers and the new fuel is fed from the opposite sides, i.e. from the explosion part.

Accordingly, the semi-shafts 4 and 5 are not only a connecting element for connecting the connecting rod and the piston, they are also essential elements causing the working phases of the engine.

In short, in the engine according to the present invention the fuel is fed from a side of the head of the cylinder and the burnt fuel is discharged through the central part of the cylinder itself. In this way, an excellent washing of the explosion chamber A-B is reached during the substitution of the gases, the consumption of fuel being lower and efficiency being higher.

As an advantage, the engine according to the present invention may be carried out with or without valves, the two working phases being unchanged in a turn of 360° of the connecting rod. Moreover, non-return valves of any type may be used when necessary.

Another advantage is represented by the fact that the application of one or more intake valves for the gases may replace the said narrowings, holes or leaks of the said semi-shafts, which intake valves are controlled by the semi-shafts or other auxiliary mechanisms.

In addition, there is the possibility of using two crankshafts and two connecting rods. In this case, the effort is distributed on two points and as a result, the motion parts are lightened and two force inlets may be used.

The present engine may be carried out according to several versions, i.e. intake with carburettor, injection, with rotating valves and with the possibility of arranging the auxiliary pistons 14 and 15 apart from the coaxial shafts. In fact, the auxiliary pistons 14 and 15 may be arranged also out of the respective semi-shaft. Such pistons may be substituted by other similar components for intaking the gas in the explosion chambers and may be controlled by other elements and not by the same shaft.

In case the engine is provided with valves, several distribution elements such as chain, rods and distribution gears are eliminated.

One of the advantages of the present engine is to eliminate the problem of the ovalization of the cylinder. In addition, there is not the risk of seizure between piston and cylinder since such elements come never in touch with one another. The only elements of contact are the elastic bands.

The present engine has been described and illustrated according to a preferential solution. Anyhow, there may be variants, equivalent technically to the described mechanical parts and components, which are to be considered included in the range of protection of the present invention.

I claim:

1. High-efficiency engine provided with a double-acting piston cooperating with auxiliary feed and inlet units, the engine comprising: a cylinder (2) having a central axis a piston (3) slidably mounted in the cylinder; a through-shaft fixed on said central axis, said through-shaft being subdivided by the piston into coaxial semi-shafts (4,5) shaped with outer ends with auxiliary pistons (14,15) which slide in inlet chambers (10,11), at least one of the two outer ends of said semi-shafts (4,5) being dovetailed in a connecting rod (16); said inlet chambers (10,11) being provided with non-return valves (19,20) for permitting the gases to be fed to the inlet chambers and said cylinder being provided with exhaust openings (21) in its central part.

2. High-efficiency engine as claimed in claim 1, characterized by the fact that beginning from the piston (3) outwards the said two semi-shafts (4, 5) pass through openings (6, 7) which may be provided with elastic bands or similar gaskets or packings, which openings are made in heads (8, 9) which are fixed to both ends of the cylinder (2), and said semi-shafts (4, 5) pass through suitable inlet chambers (10, 11) obtained in the heads (8, 9).

3. High-efficiency engine as claimed in the claim 1, characterized by the fact that said piston (3) and the relative coaxial semi-shafts (4, 5) may be displaced axially and cyclically according to two active explosions with a turn of 360° of the connecting rod.

4. High-efficiency engine as claimed in the claim 1, characterized by the fact that said semi-shafts (4, 5) show narrowings (12, 13) whose most external parts end in auxiliary pistons (14, 15) which slide in the inlet chambers (10, 11).

5. High-efficiency engine as claimed in the claim 1, characterized by the fact that the said narrowings (12, 13) permit the intake gas to pass through respective explosion chambers (A and B).

6. High-efficiency engine as claimed in the claim 1, characterized by the fact that said cylinder (2) is provided with suitable seats (22 and 23) at opposite sides of the head, in which seats sparking-plugs are inserted.

7. High-efficiency engine as claimed in the claim 1, characterized by the fact that it can be coupled with two crankshafts and therefore with two connecting rods, and in this case the effort is distributed on two points.

8. High-efficiency engine as claimed in the claim 1, characterized by the fact that all the pistons (3, 14, 15) may be provided with gaskets and the outer parts (24, 25) of both semi-shafts (4, 5) may slide in suitable supports.

* * * * *